US012637277B2

(12) United States Patent
Hurley

(10) Patent No.: US 12,637,277 B2
(45) Date of Patent: May 26, 2026

(54) MODULAR CORNER GUARD

(71) Applicant: Jonathan Hurley, Columbia Falls, MT (US)

(72) Inventor: Jonathan Hurley, Columbia Falls, MT (US)

( * ) Notice: Subject to any disclaimer, the term of this patent is extended or adjusted under 35 U.S.C. 154(b) by 0 days.

(21) Appl. No.: 18/814,924

(22) Filed: Aug. 26, 2024

(65) Prior Publication Data

US 2026/0054909 A1 Feb. 26, 2026

(51) Int. Cl.
*B65D 81/05* (2006.01)

(52) U.S. Cl.
CPC ..... *B65D 81/054* (2013.01)

(58) Field of Classification Search
CPC ..... B65D 19/06; B65D 81/053; B65D 81/054
USPC ..... 206/453, 586
See application file for complete search history.

(56) References Cited

U.S. PATENT DOCUMENTS

| | | | | |
|---|---|---|---|---|
| 3,410,474 | A * | 11/1968 | Keil | B65D 81/056 297/DIG. 2 |
| 4,055,362 | A | 10/1977 | Becker, III | |
| 4,292,901 | A | 10/1981 | Cox | |
| 4,553,484 | A * | 11/1985 | Cox | B65D 19/06 403/353 |
| 4,714,163 | A * | 12/1987 | Reeves | B65D 59/00 206/521 |
| 4,910,280 | A | 3/1990 | Robbins, III | |
| 5,115,917 | A * | 5/1992 | Schrage | B65D 11/22 108/55.1 |
| 6,988,615 | B2 * | 1/2006 | Merkel | B65D 81/058 206/320 |

(Continued)

FOREIGN PATENT DOCUMENTS

| | | | |
|---|---|---|---|
| CN | 20642866 | U | 8/2017 |
| CN | 211919563 | U | 11/2020 |
| CN | 216810729 | U | 6/2022 |
| FR | 2777262 | A1 | 10/1999 |

OTHER PUBLICATIONS

Idealwarehouse.com, Knuffi, "Warning and Protective Guards", <https://idealwarehouse.com/wp-content/uploads/2023/12/Knuffi_EN-HI-IW-L-202311.pdf>, brochure, at least as early as Nov. 2023, 8 pages.

(Continued)

*Primary Examiner* — Luan K Bui

(74) *Attorney, Agent, or Firm* — Christensen O'Connor Johnson Kindness PLLC

(57) ABSTRACT

A modular corner guard is constructed of two elongated, wall sections that are disposed generally at right angles to each other. The wall sections include generally planar exterior surfaces that intersect a juncture wall or end wall that in essence creates a truncated or beveled outer corner at the exterior of the corner guard. The wall sections at the opposite sides from the juncture wall are in the form of curved or rounded exterior edge portions. The interior of the modular corner guard is constructed in the form of a lattice of open cells defined by spaced apart partition walls that extend transversely relative to the length of the wall sections. The inward edges of the partition walls lie in a common plane to cooperatively form the two interior surfaces of the modular corner guard. These two interior surfaces are disposed at right angles to each other, to enable the interior surfaces to overlie and bear against the corner of the structure on which the corner guard is mounted.

20 Claims, 9 Drawing Sheets

(56) References Cited

U.S. PATENT DOCUMENTS

| | | | | |
|---|---|---|---|---|
| 7,320,403 | B2 * | 1/2008 | May, Jr. | B65D 81/053 206/320 |
| 7,727,614 | B2 * | 6/2010 | Stubing | B65D 81/053 229/199 |
| 8,074,952 | B2 * | 12/2011 | Baechle | D06F 39/001 229/113 |
| 9,359,745 | B2 | 6/2016 | Serrurier et al. | |
| 2005/0092633 | A1 * | 5/2005 | Baechle | B65D 61/00 206/320 |
| 2006/0005875 | A1 * | 1/2006 | Haberlein | F24S 80/00 136/251 |

OTHER PUBLICATIONS

Ganter Norm, GN 2181 Edge Protection Seal Profile Corners, <https://www.ganternorm.com/en/products/3.3-Hinging-latching-locking-of-doors-and-covers/Edge-protection-profiles/GN-2181-Edge-protection-seal-profile-corners>, at least as early as Oct. 2020, 3 pages.

Gulf Rubber Industries LLC, "Rubber Moulding: Moulded Corners", <https://grigulf.com/product/rubber-moulding-moulded-corners/>, copyright 2017, 4 pages.

Kirstein.de, "Stagecaptain KS-8010 Corner Protection", <https://www.kirstein.de/docs/manuals/st-KS-8010-1119.pdf>, manual, Nov. 2019, 8 pages.

Pig, Pig Barrier Dike Corner, <https://www.grainger.com/ec/pdf/NEW-PIG-PLR268-Corner-for-SpillBlocker-Dike-Spec-Sheet.pdf>, 2014, 2 pages.

* cited by examiner

MODULAR CORNER GUARD

BACKGROUND

The present disclosure pertains to a modular guard or protector for the corners or edges of moving items and stationary structures, for example rolling tool chests, pallet loads, wall corners, etc. Such corners or edges are typically of various heights or lengths. It would be advantageous if guards or protectors of a desirable or appropriate length could be mounted on such corners or edges to provide continuous coverage for the entire desired or appropriate length. The present disclosure seeks to provide a modular guard or protector that can be connected and locked end-to-end to any desired or appropriate length.

SUMMARY

This summary is provided to introduce a selection of concepts in a simplified form that are further described below in the Detailed Description. This summary is not intended to identify key features of the claimed subject matter, nor is it intended to be used as an aid in determining the scope of the claimed subject matter.

In accordance with one embodiment of the present disclosure, an elongated, modular corner guard is provided. The modular corner guard incudes first and second elongated wall sections having exterior portions that intersect along their lengths at a truncated corner juncture. The first and second wall sections each having an interior portion that is disposed at right angles to each other to be attachable to a corner of an object to be protected. The interiors of the first and second wall sections comprising a lattice of open cells. A tongue projecting longitudinally from one end of the corner guard, and a recess formed in the opposite end of the corner guard to snugly receive a tongue extending from the adjacent end of an adjacent corner guard.

In any of the embodiments described herein, the tongue flares laterally outward as the tongue extends away from the end of the corner guard.

In any of the embodiments described herein, the recess flares laterally outward as the recess extends into the opposite end of the corner guard to receive the tongue extending from the adjacent end of the adjacent corner guard in locking relationship.

In any of the embodiments described herein, a lattice of hollow cells is formed by partition walls located in the interior of the first and second wall sections, the partition walls are disposed transversely to the lengths of the first and second wall sections and spaced apart from each other to define an open cell between adjacent partition walls.

In any of the embodiments described herein, the partition walls have edges that are coplanar to each other to cooperatively define the interior portions of the first and second wall sections, the plane defined by the edges of one wall section disposed at a right angle to the plane defined by the edges of the second wall section.

In any of the embodiments described herein, the tongue flares laterally outward as the tongue extends away from the end of the corner guard.

In any of the embodiments described herein, the tongue forms a first interior tongue surface that is coplanar with the interior surface the first wall section and the tongue forming a second interior tongue surface that is coplanar with the interior surface of the second wall section.

In any of the embodiments described herein, the recess flares laterally outward as the recess extends into the opposite end of the corner guard to receive the tongue extending from the adjacent end of the adjacent corner guard in locking relationship.

In any of the embodiments described herein, the partition walls define at least one magnet recess for receiving therein a magnet for attaching the corner guard to a ferromagnetic surface to be protected.

In any of the embodiments described herein, the at least one magnet recess is sized and positioned relative to the partition walls so that an exposed surface of the magnet when received in the magnet recess is coplanar with the edges of the partition walls.

In any of the embodiments described herein, the partition walls define at least one surface that is substantially coplanar with the edges of the partition wall to define a surface for receiving an adhesive for attaching the corner guard to a surface to be protected.

In accordance with another embodiment of the present disclosure, an elongated, modular corner guard is provided. The modular corner guard includes first and second elongated wall sections disposed at an angular relationship to each other. The first and second wall sections each define an interior surface that are disposed at right angles to each other to be attachable to a corner of an object to be protected. The first and second wall sections having exterior surfaces that are disposed angularly to each other and intersect along their lengths to the sides of a juncture wall that is symmetrical to the right angle defined by the interior surfaces of the first and second wall sections. The interior of first and second wall sections comprising a lattice of open cells. A tongue projects longitudinally from one end of the corner guard and a recess is formed in the opposite end of the corner guard to snugly receive a tongue extending from the adjacent end of an adjacent corner guard.

In any of the embodiments described herein, the lattice of hollow cells is formed by partition walls located in the interior of the first and second wall sections, the partition walls are disposed transversely to the length of the first and second wall sections and spaced apart from each other to define an open cell between adjacent partition walls.

In any of the embodiments described herein, the partition walls have edges that are coplanar to each other to cooperatively define the interior of the first and second wall sections, the plane defined by the edges of one wall section is disposed at a right angle to the plane defined by the edges of the second wall section.

In any of the embodiments described herein, the tongue flares laterally outward as the tongue extends away from the end of the corner guard.

In any of the embodiments described herein, the tongue forming a first interior tongue surface that is coplanar with the interior surface the first wall section and the tongue forming a second interior tongue surface that is coplanar with the interior surface of the second wall section.

In any of the embodiments described herein, the recess flares laterally outward as the recess extends into the opposite end of the corner guard to receive the tongue extending from the adjacent end of the adjacent corner guard in locking relationship.

In any of the embodiments described herein, the partition walls define at least one magnet recess for receiving therein a magnet for attaching the corner guard to a ferromagnetic surface to be protected.

In any of the embodiments described herein, the at least one magnet recess is sized and positioned relative to the partition walls so that an exposed surface of the magnet when received in the magnet recess is coplanar with the edges of the partition walls.

In any of the embodiments described herein, the partition walls define at least one surface that is substantially coplanar with the edges of the partition wall to define a surface for receiving an adhesive for attaching the corner guard to a surface to be protected.

DESCRIPTION OF THE DRAWINGS

The foregoing aspects and many of the attendant advantages of this invention will become more readily appreciated as the same become better understood by reference to the following detailed description, when taken in conjunction with the accompanying drawings, wherein.

DETAILED DESCRIPTION

Figure 1:
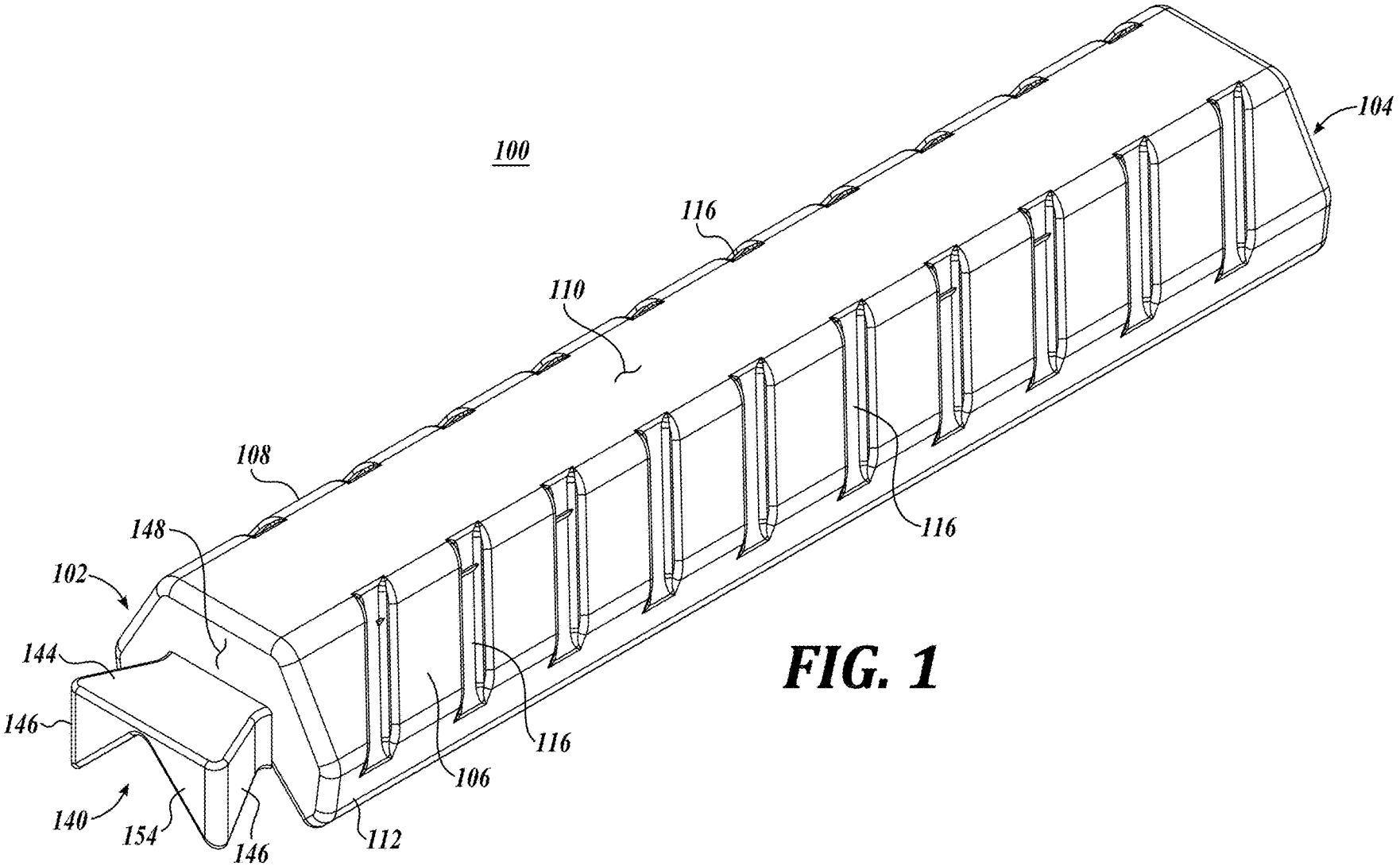
FIG. 1 is a pictorial view of the exterior of an elongated modular corner guard of the present disclosure taken from above and from one end thereof.

Various example embodiments of the present disclosure are described below with reference to the accompanying drawings in which some example embodiments are illustrated. In the figures, the thicknesses of lines, layers and/or regions may be exaggerated for clarity.

While example embodiments are capable of various modifications and alternative forms, embodiments thereof are shown by way of example in the figures and are described in detail below. It should be understood, however, that there is no intent to limit example embodiments to the particular forms disclosed, but on the contrary, example embodiments are to cover all modifications, equivalents, and alternatives falling within the scope of the disclosure.

It is understood that when an element is referred to as being "connected" or "coupled" to another element, it can be directly connected or coupled to the other element or intervening elements may be present. In contrast, when an element is referred to as being "directly connected" or "directly coupled" to another element, there are no intervening elements present. Other words used to describe the relationship between elements should be interpreted in a like fashion (e.g., "between" versus "directly between," "adjacent" versus "directly adjacent,"etc.).

The terminology used herein is for the purpose of describing particular embodiments only and is not intended to be limiting of example embodiments. As used herein, the singular forms "a," "an" and "the" are intended to include the plural forms as well, unless the context clearly indicates otherwise. It will be further understood that the terms "comprises," "comprising," "includes" and/or "including," when used herein, specify the presence of stated features, integers, steps, operations, elements and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which example embodiments belong. It will be further understood that terms, e.g., those defined in commonly used dictionaries, should be interpreted as having a meaning that is consistent with their meaning in the context of the relevant art. However, should the present disclosure give a specific meaning to a term deviating from a meaning commonly understood by one of ordinary skill, this meaning is to be considered in the specific context this definition is given herein.

In the following description, numerous specific details are set forth in order to provide a thorough understanding of exemplary embodiments of the present disclosure. It will be apparent to one skilled in the art, however, that many embodiments of the present disclosure may be practiced without some or all of the specific details. Further, it will be appreciated that embodiments of the present disclosure may employ any combination of features described herein.

The present application may include references to directions, such as "forward," "rearward," "front," "back," "ahead," "behind," "upward," "downward," "above," "below," "top," "bottom," "right hand," left hand," "in," "out," "extended," "advanced," "retracted," "proximal," "distal," "central," "vertical," etc. These references and other similar references in the present application are only to assist in helping describe and understand the present invention and are not intended to limit the present invention to these directions or locations.

The present application may also reference quantities and numbers. Unless specifically stated, such quantities and numbers are not to be considered restrictive, but exemplary of the possible quantities or numbers associated with the present application. Also, in this regard, the present application may use the term "plurality" to reference a quantity or number. In this regard, the term "plurality" is meant to be any number that is more than one, for example, two, three, four, five, etc.

The present application may include modifiers such as the words "generally," "approximately," "about", or "substantially." These terms are meant to serve as modifiers to indicate that the "dimension," "shape," "temperature," "time," or other physical parameter in question need not be exact, but may vary as long as the function that is required to be performed can be carried out. For example, in the phrase "generally circular in shape," the shape need not be exactly circular as long as the required function of the structure in question can be carried out. If a quantitative value is needed to render the applicable parameter sufficiently definite, the applicable parameter is within five percent (5%) of the designated parameter value.

Further, the term "mechanic's tools" may include all manner of tools used by mechanics, including, but not limited to, wrenches, pliers, screw drivers, sockets, socket wrenches, rachet wrenches, hex wrenches, etc.

In the following description, various embodiments of the present disclosure are described. In the following description and in the accompanying drawings, the corresponding systems assemblies, apparatus, and units may be identified by the same part number, but with an alpha suffix or by a prime ("') or double prime ("") or even a triple prime ("""') designation. The descriptions of the parts/components of such systems assemblies, apparatus, and units that are the same or similar are not repeated so as to avoid redundancy in the present application.

Referring initially to FIGS. 1-8, in one embodiment of the present disclosure, a modular corner guard 100 in basic form is shown as constructed of two elongated, wall sections 102 and 104 that are disposed generally at right angles to each other. The wall sections include generally planar exterior surfaces or portions 106 and 108 that intersect a juncture wall or end wall 110 that in essence creates truncated or beveled outer corner of the exterior of the corner guard 100. The wall sections at the opposite sides of the exterior portions 106 and 108 intersect curved or rounded exterior edge portions 112 and 114, respectively.

A series of shallow cross grooves 116 extend across the exterior surfaces or portions 106 and 108 and across portions of the edge portions 112 and 114. The cross grooves are disposed diagonally relative to the lengths of the wall sections 102 and 104 when viewed in FIGS. 3 and 4.

It is to be noted that the exterior configuration of the corner guard 100 can be of constructions and shapes other than as shown in the Figures. For example, rather than in the form of the juncture or end wall illustrated, the exterior surfaces or portions 106 and 108 can intersect at a corner, and such corner can be substantially sharp or can be rounded or slightly beveled.

One attribute of constructing the exterior of the corner guard 100 in the manner described above is that the wall sections 102 and 104 can be substantially of uniform thickness when the corner guard is viewed in cross section. See, for example, FIGS. 5 and 6. Also, the corner guard 100 presents a blunt corner to the exterior so as to be less likely to cause damage to the corner guard or to a structure or body that the corner guard might strike.

Figure 2:
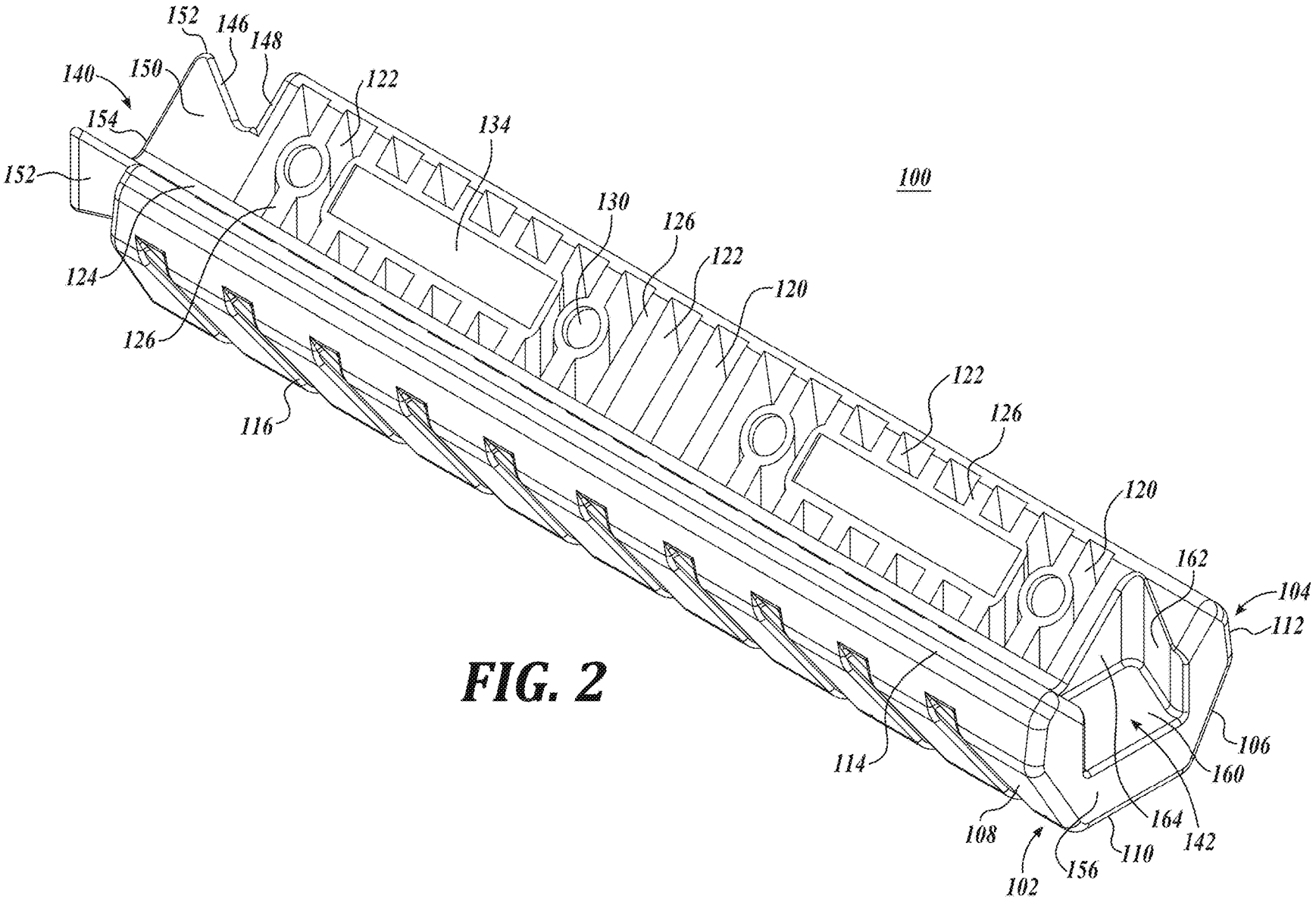
FIG. 2 is a pictorial view similar to FIG. 1 directed to the interior of the elongated modular corner guard of FIG. 1.
Figure 3:
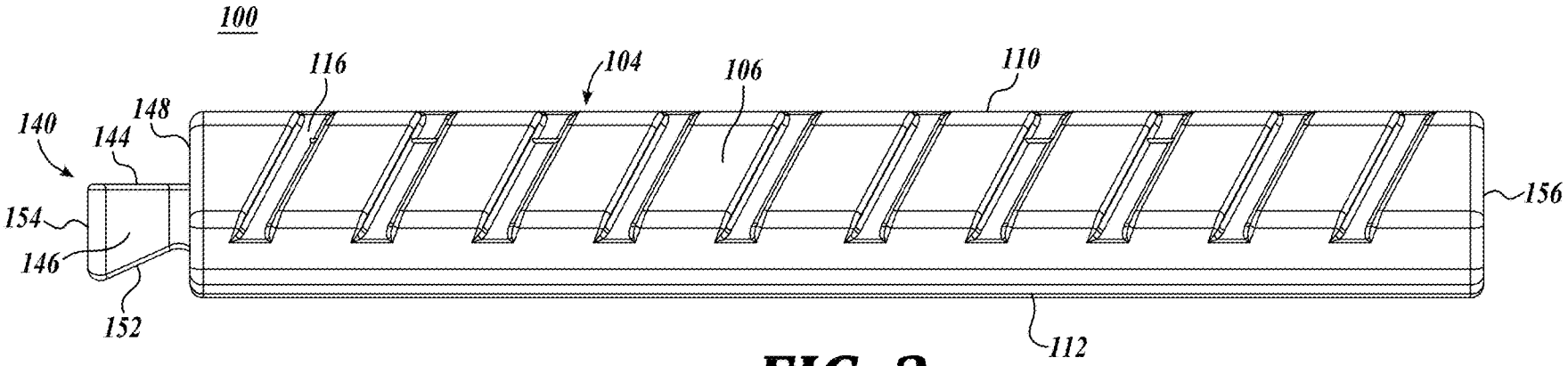
FIG. 3 is a side elevation of view of the exterior of the elongated modular corner guard of FIG. 1.
Figure 4:
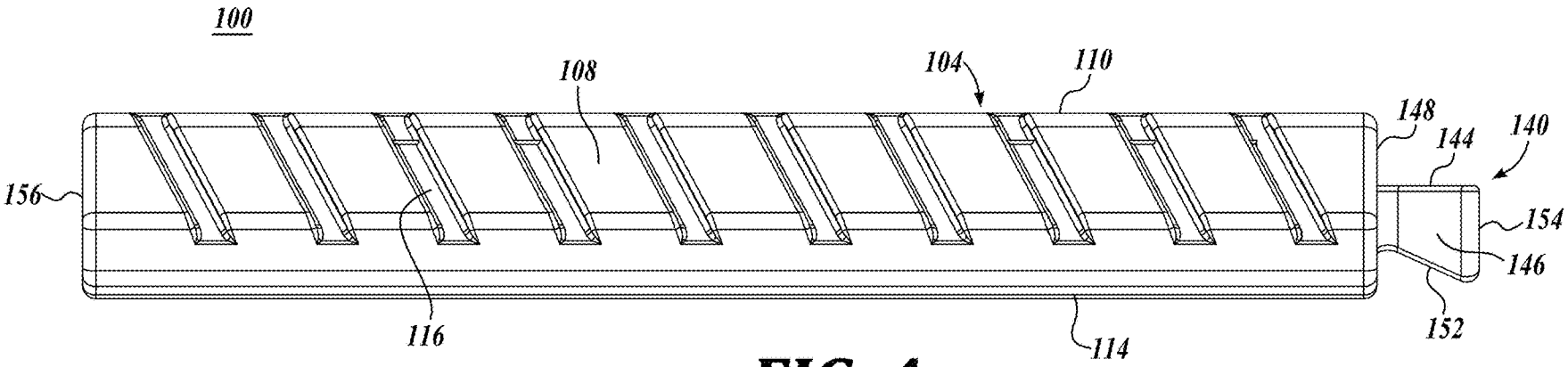
FIG. 4 is a view similar to FIG. 3 taken from the opposite side of the exterior of the elongated modular corner guard.
Figure 8:
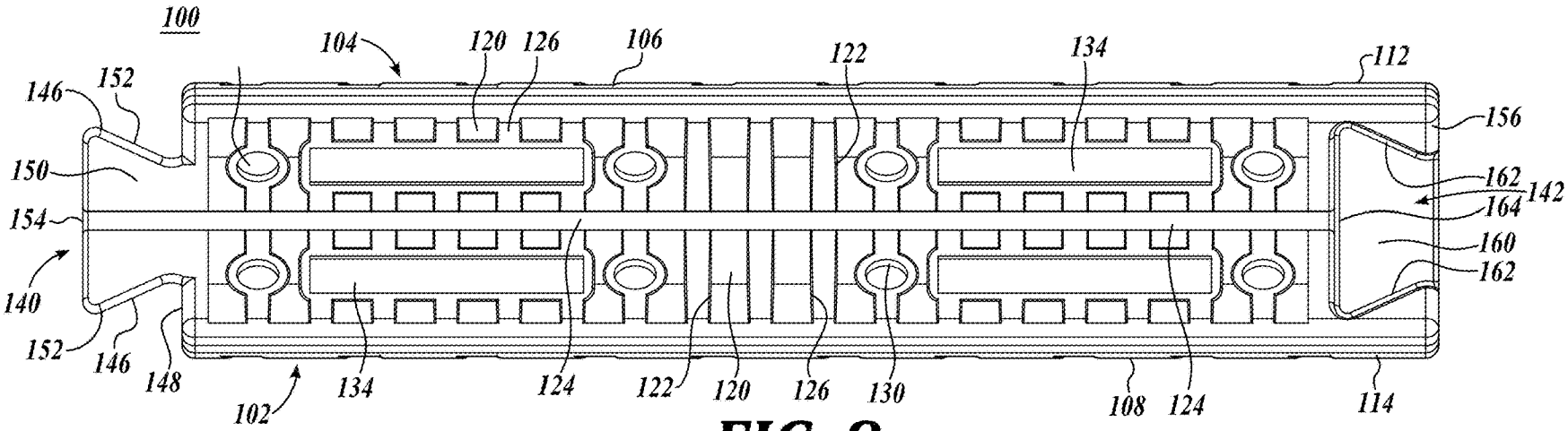
FIG. 8 is the bottom view of the elongated modular corner guard of FIG. 1.
Figure 9:
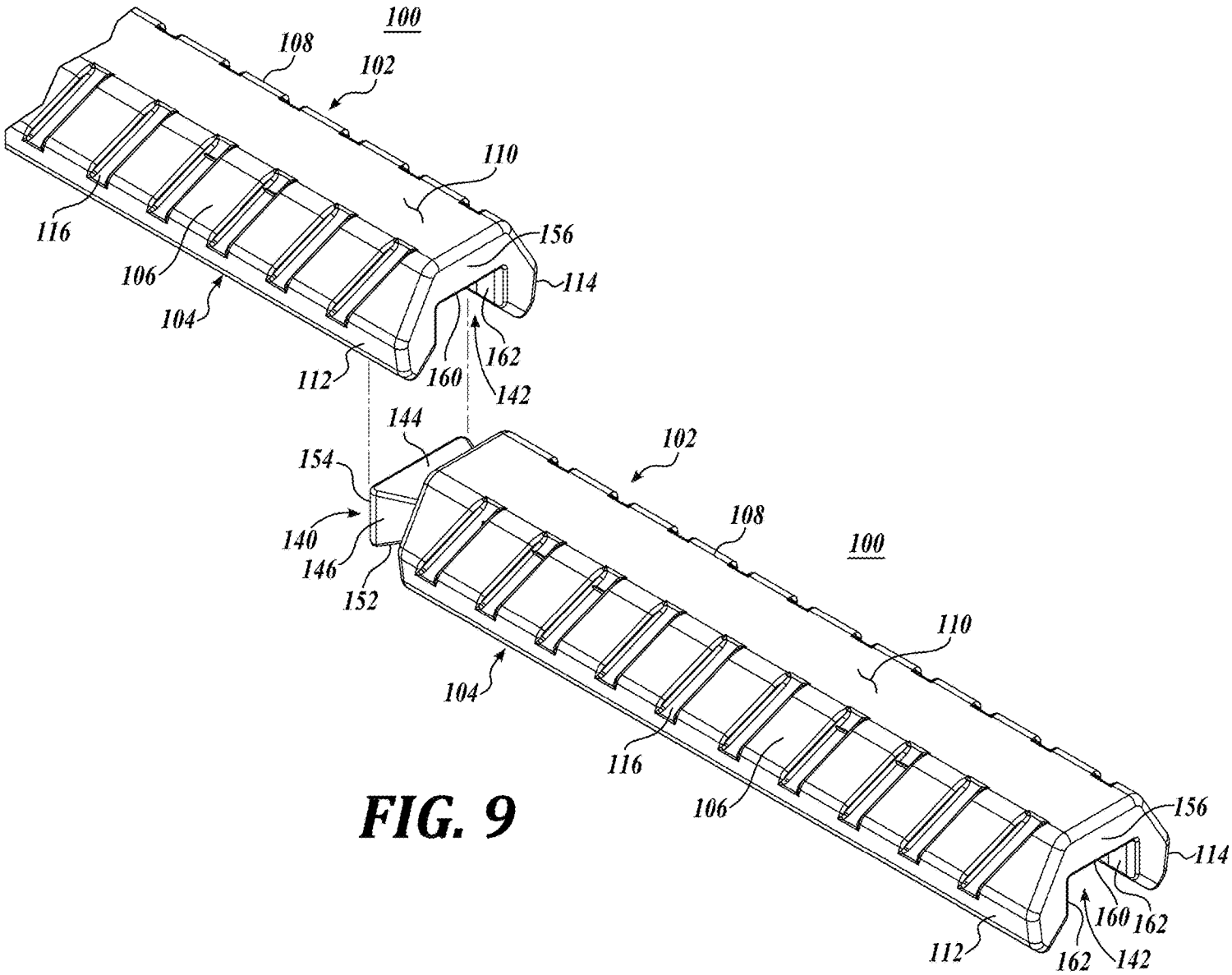
FIG. 9 is a pictorial view of two elongated modular corner guards illustrating the matter in which the corner guards are attachable together end to end.

The interior construction of the modular corner guard 100, as shown in FIGS. 2 and 8, is constructed in the form of a lattice of open cells 120. The cells 120 are defined by spaced apart partition walls 122 that extend transversely relative to the length of the wall sections 102 and 104. A center wall 124 extends longitudinally along the center of the of the interior of the modular corner guard. The partition walls 122 intersect the center wall 124. From the center wall 124, the partition wall extends outward to intersect the interior surfaces of the exterior portions 106 and 108 and also intersect interior surfaces of the exterior edge portions 112 and 114.

The modular corner guard 100 can be manufactured without the center wall 124. However, the center wall 124 does add structural strength to the corner guard.

The edges 126 of the partition walls 122 lie in a plane to cooperatively form the two interior bearing surfaces of the modular corner guard. These two interior bearing surfaces are disposed at right angles to each other, to enable the interior surfaces to overlie or bear against the corner of the structure on which the corner guard 100 is mounted. It will be noted that the center wall 124 is at the apex of these interior surfaces.

It will be appreciated, that by the above construction of the modular corner guard 100, the wall sections 102 and 104 can be constructed of sufficient thickness and sufficient structural integrity, while minimizing the material needed to construct the modular corner guard.

Figure 12:
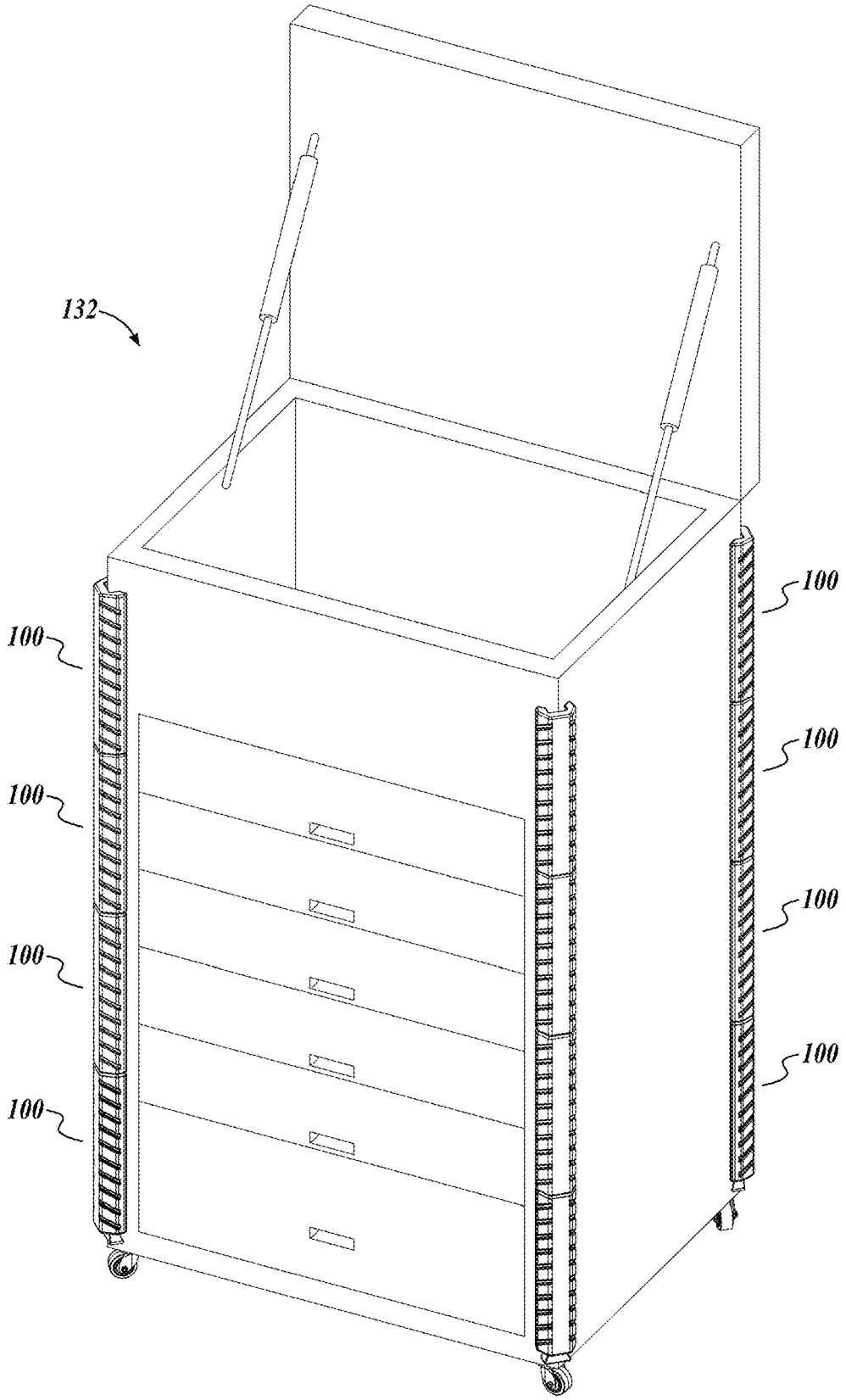
FIG. 12 illustrates elongated modular corner guards attached together and mounted on the corners of a rolling tool chest to protect the chest as well as objects which the chest may strike.

As shown in FIGS. 2 and 8, recessed bosses 130 are incorporated into the structure of certain partition walls 122. The recessed boss 130 are designed to received magnets therein, not shown. The depths of the recesses of the bosses 130 are selected so that when magnets are mounted on the bosses, the exposed surfaces of the magnets are coplanar with the surfaces of the edges 126 of the partition walls. As such, the magnets can be used to attach the corner guards to the corner portions of ferromagnetic structures and surfaces, such as the rolling tool chest 132 shown in FIG. 12. The magnets can be affixed to the bosses by any convenient means, including, for example, by use of an adhesive or by use of an interference fit between the exterior of the magnets and the interior walls of the recess.

The bosses 130 are shown as being round in shape; however, the bosses can be of other shapes, such as square, pentagonal, hexagonal, etc. Also, although four bosses are shown along each interior surface of the corner guard, a different number of bosses can be employed and the bosses can be arranged in locations other than as shown in FIGS. 2 and 8.

In addition to, or in lieu of, the recessed bosses 130, elongated, rectangular bosses or mounting surfaces 134 can incorporated into the structure of a series of adjacent partition walls 122. The bosses 134 are designed to receive an adhesive for attaching the modular guard 100 to a mounting structure. As shown in the figures, the rectangular bosses can span several partition walls 122.

Although the bosses 134 are shown as being rectangular in shape, the bosses can be of shapes, such as for example triangular, oval or elliptical. Also, the bosses 134 can be positioned differently along the partition walls than as shown in FIGS. 2 and 8.

The surfaces of bosses 134 can be substantially coplanar with the edges 126 of the partition walls if an adhesive is being applied directly on the bosses 134. However, if a double backed adhesive tape is being used to mount the modular guard, the surfaces of the bosses can be slightly recessed from the edges 126 of the partition walls 122, but need not be.

The modular corner guards 100 can be of various lengths. For example, the modular corner guards can be from about 4 inches to about 24 inches in length, or longer in length. Further, the corner guards are designed to be attached together end-to-end to protect the corner of a structure of any desired length. For example, for the tool chest 132 shown in FIG. 12, four corner guards 100 are linked together end-to-end to protect the corners along substantially the entire height of the tool chest.

As an example, in one form a tongue 140 extends from one end 148 the modular corner guard 100 to be snugly receivable into a close-fitting socket or recess 142 formed in the adjacent end 156 of an adjacent modular corner guard. The tongue has a flat base 144 and parallel outer sides 146 that flare or extend laterally outwardly in the direction longitudinally outward from the end 148 of the corner guard.

The tongue 140 also has inward faces 150 the are coplanar with the plane defined by the edges 126 of the partition walls. In this regard, the inward faces 150 are at right angles to each other and thus define the tongue as composed of two lateral sections 152. The distal ends 154 of the lateral sections 152 are parallel to the end 148 of the corner guard.

The socket or recess 142 is shaped and sized to closely receive the tongue 140 of an adjacent corner guard 100 in securely locking relationship. In this regard, the recess 142 includes a base surface 160 that the flat base portion 144 of the tongue lies against when two corner guards 100 are in locked relationship. The flat base surface 160 is parallel to the to juncture or end wall 110.

The recess 142 also includes side walls 162 that flare or extend laterally outwardly in the longitudinal direction extending inward from the end 156 of the corner guard. In this manner the outer sides 146 of the tongue 140 bear against the side walls 162. Further, the inward ends 164 of the recess provide a bearing surface for the distal ends 154 of the tongue lateral sections 152.

Figure 10:
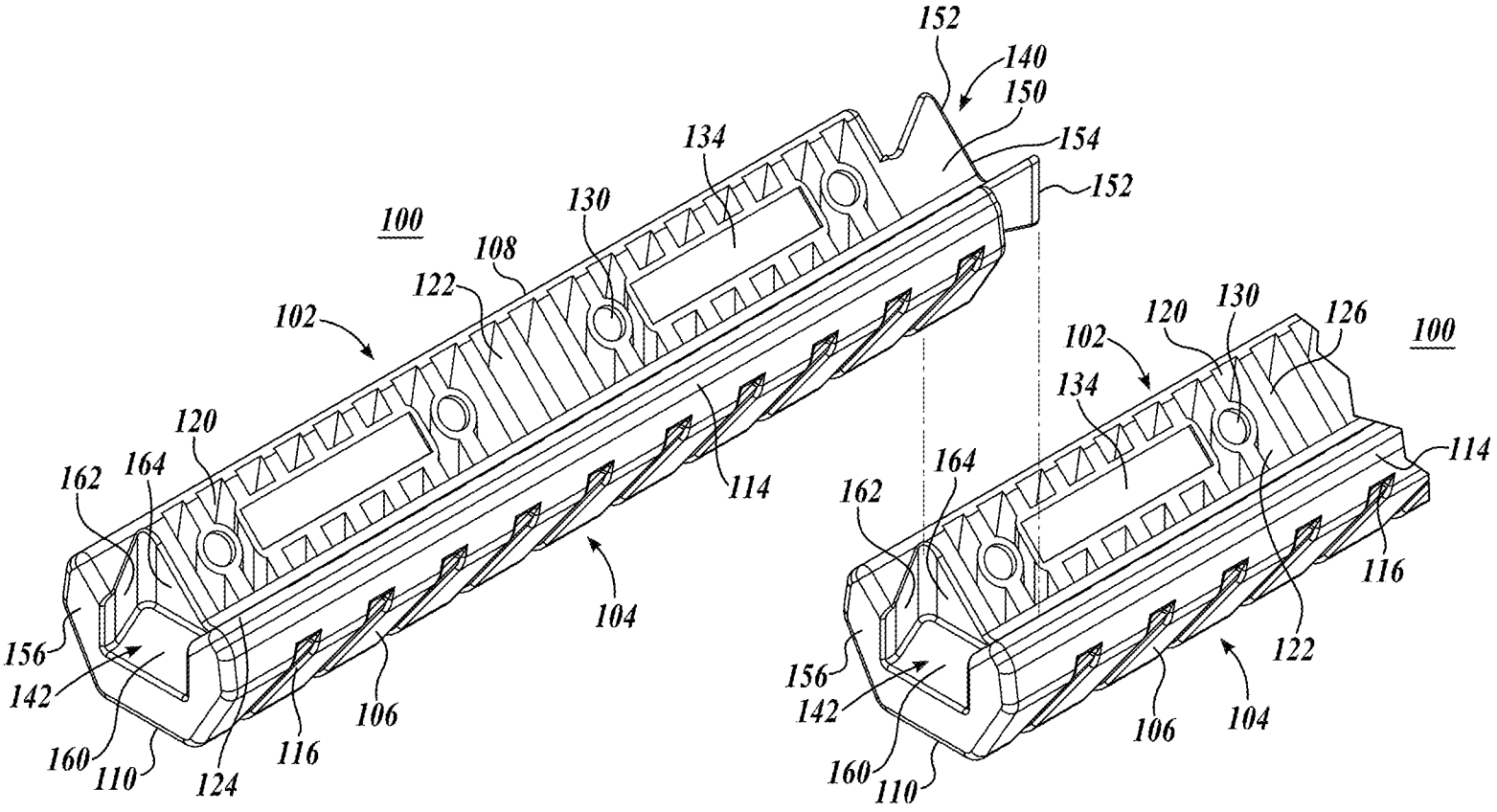
FIG. 10 is a pictorial view similar to FIG. 9 showing interior views of the two corner guards that are attachable together end to end.
Figure 11A:
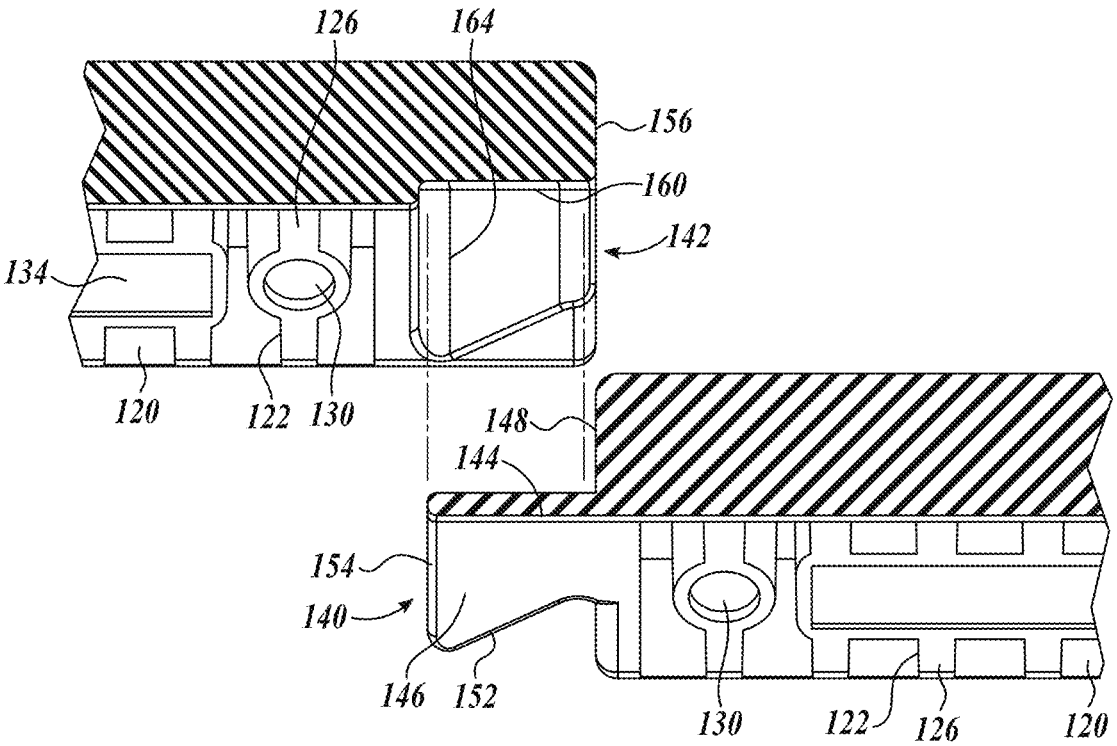
FIG. 11A is an enlarged fragmentary cross-sectional view illustrating the manner in which two adjacent elongated modular corner guards may be attached together end-to-end.
Figure 11B:
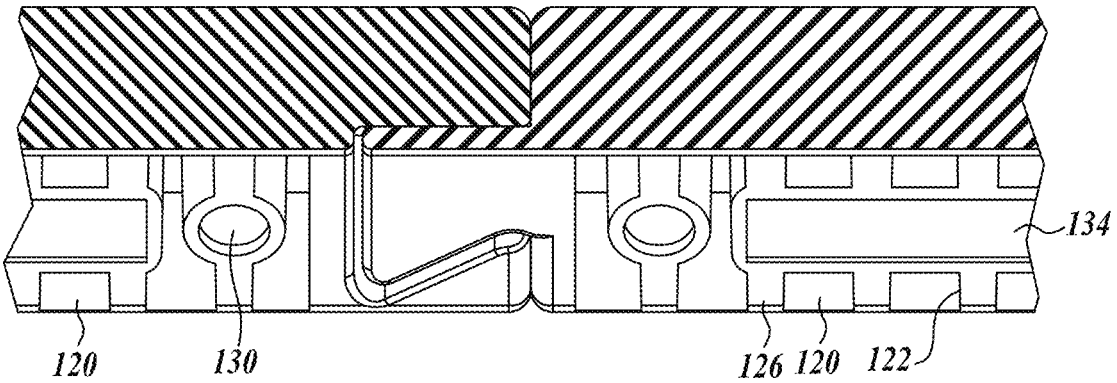
FIG. 11B is a view similar to FIG. 11A showing the two adjacent elongated modular corner guards attached together end-to-end.

It will be noted that by the above construction, the tongue 140 can be slidingly engaged into a recess 142 in a lateral direction as shown in FIGS. 10, 11A and 11B. Once engaged the flared walls or outer sides 146 bear against the corresponding flared recess side walls 162, the longitudinally adjacent corner guards are locked together and prevented from disengaging in the direction longitudinally of the corner guards.

It is to be noted that the above described and illustrated tongue 140 and recess 142 is only one manner in which the corner guards can be connected together. Another way of attaching the conner guards end the end is to form longitudinal blind holes in the ends 148 and 156 and insert dowels into the blind holes to join the corner guards end-to-end. The dowels cab be sized to form an interference fit with the blind holes. Also, the exterior surface of the dowels can be in the form of saw teeth, can be ribbed or can be otherwise textured or configured to lock the dowels into the blind holes.

Figure 6:
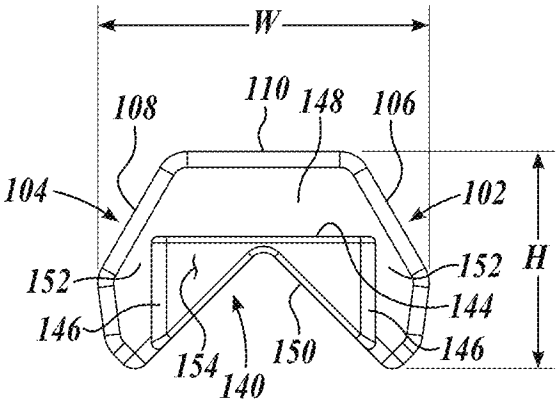
FIG. 6 is an end view of the elongated modular corner guard shown in FIG. 4 taken from the left hand side thereof.
Figure 5:
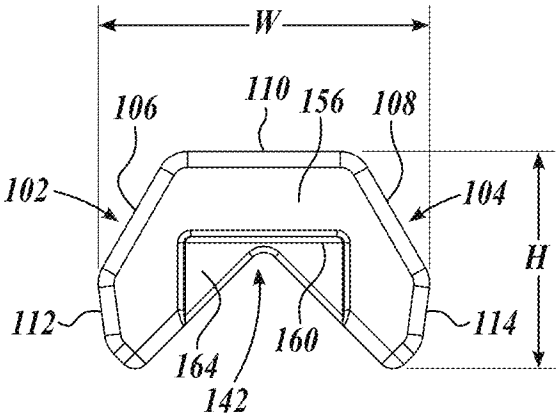
FIG. 5 is an end view of the elongated modular corner guard shown in FIG. 3 taken from the left hand side thereof.
Figure 7:
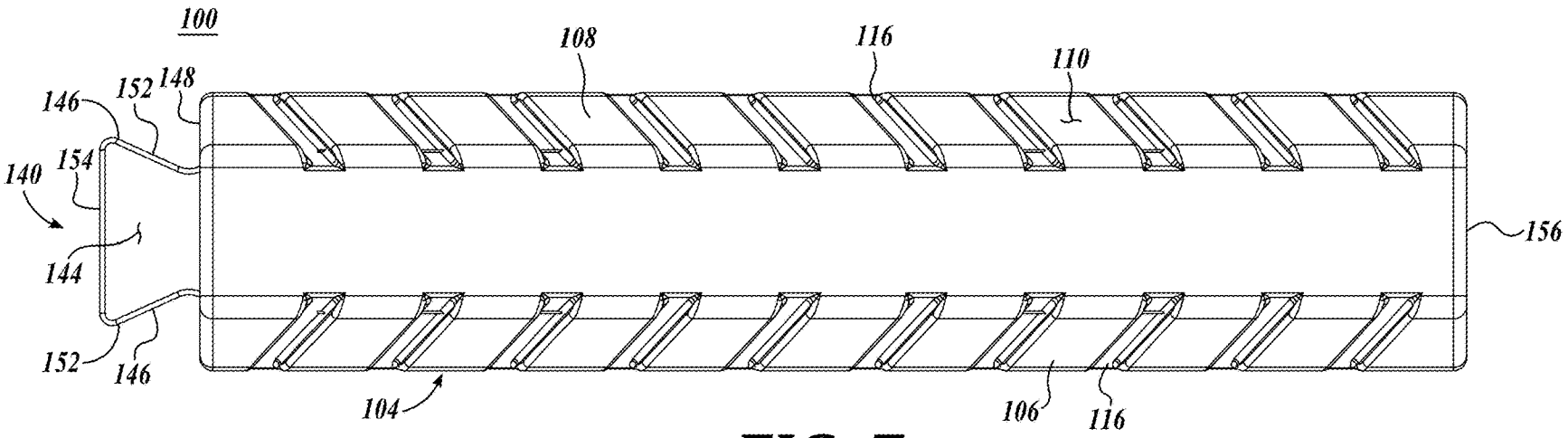
FIG. 7 is a top view of the elongated modular corner guard of FIG. 1.

While illustrative embodiments have been illustrated and described, it will be appreciated that various changes can be made therein without departing from the spirit and scope of the invention. For example, in addition to being of various lengths, the corner guards 100 can be of various sizes. As merely one example, as shown in FIGS. 5 and 6, the cross-sectional height H of the corner guard 100 can be from about 1.5 to about 2.5 inches. Further, the cross-sectional width W of the corner guard 100 can be from about 2.0 to about 3.5 inches. In addition, the thickness of the partition walls 122 can be from about 0.1 inches to about 0.3 inches.

As another example, the corner guards can be composed of various materials including materials that exhibit resiliency or elasticity when compressed, such as if the corner guards strike an object or if stricken by an object. Such materials may include, for example, rubber, synthetic rubber such as silicon rubber and other elastomeric materials. The thickness, density, durometer and other properties of the elastomeric material can be selected based on the specific application of the corner guards. If the corner guards are to withstand heavy impacts, then the properties of the material can be selected accordingly.

It is also desirable that the exterior surface of the corner guards by scuff or abrasion resistance to retain its structural integrity and appearance. In this regard, the exterior surface of the corner guards can be textured or otherwise configured to retain its integrity and appearance after encountering loads or impacts.

It is to be understood that these are merely examples and do not limit the scope of the present invention.

The embodiments of the invention in which an exclusive property or privilege is claimed are defined as follows:

1. An elongated, modular corner guard for attaching to a corner of an objected to be protected, comprising:

first and second elongated wall sections having exterior portions that intersect along their lengths at a truncated corner juncture, the first and second elongated wall sections each having an interior portion that is disposed at right angles to each other to be attachable to a corner of an object to be protected;

a tongue projecting longitudinally from one end of the corner guard;

a recess formed in the opposite end of the corner guard to snugly receive a tongue extending from the adjacent end of an adjacent corner guard; and the interior portions of the first and second elongated wall sections comprising a lattice of open cells extending along the first and second elongated wall sections from the tongue to the recess.

2. The modular corner guard of claim 1, wherein the tongue flares laterally outward as the tongue extends away from the end of the corner guard.

3. The modular corner guard of claim 2, wherein the recess flares laterally outward as the recess extends into the opposite end of the corner guard to receive the tongue extending from the adjacent end of the adjacent corner guard in locking relationship.

4. The modular corner guard of claim 1 wherein the lattice of open cells is formed by partition walls located in the interior portions of the first and second elongated wall sections, the partition walls are disposed transversely to the lengths of the first and second elongated wall sections and spaced apart from each other to define an open cell between adjacent partition walls.

5. The modular corner guard of claim 4, wherein the partition walls have edges that are coplanar to each other to cooperatively define the interior portions of the first and second elongated wall sections configured for bearing against the object to be protected, the plane defined by the edges of one wall section disposed at a right angle to the plane defined by the edges of the second wall section.

6. The modular corner guard of claim 5, wherein the tongue flares laterally outward as the tongue extends away from the end of the corner guard.

7. The modular corner guard of claim 6, wherein the recess flares laterally outward as the recess extends into the opposite end of the corner guard to receive the tongue extending from the adjacent end of the adjacent corner guard in locking relationship.

8. The modular corner guard of claim 5, wherein the partition walls define at least one magnet recess for receiving therein a magnet for attaching the corner guard to a ferromagnetic surface to be protected.

9. The modular corner guard of claim 8, wherein the at least one magnet recess is sized and positioned relative to the partition walls so that an exposed surface of the magnet when received in the magnet recess is coplanar with the edges of the partition walls.

10. The modular corner guard of claim 5, wherein the partition walls define at least one surface that is substantially coplanar with the edges of the partition wall to define a surface for receiving an adhesive for attaching the corner guard to a surface to be protected.

11. An elongated, modular corner guard, comprising:

first and second elongated wall sections having exterior portions that intersect along their lengths at a truncated corner juncture, the first and second elongated wall sections each having an interior portion that is disposed at right angles to each other to be attachable to a corner of an object to be protected;

the interior portions of the first and second elongated wall sections comprising a lattice of open cells;

a tongue projecting longitudinally from one end of the corner guard;

a recess formed in the opposite end of the corner guard to snugly receive a tongue extending from the adjacent end of an adjacent corner guard;

wherein the tongue flares laterally outward as the tongue extends away from the end of the corner guard, and;

wherein the tongue forming a first interior tongue surface that is coplanar with the interior surface the first elongated wall section and the tongue forming a second interior tongue surface that is coplanar with the interior surface of the second elongated wall section.

12. An elongated, modular corner guard for attachment at the corner of an objected to be protected, comprising:

first and second elongated wall sections disposed at an angular relationship to each other, the first and second elongated wall sections each defining an interior surface that are disposed at right angles to each other to be attachable to a corner of an object to be protected, the first and second elongated wall sections having exterior surfaces that are disposed angularly to each other and intersect along their lengths to the sides of a juncture wall that is symmetrical to the right angle defined by the interior surfaces of the first and second wall sections;

a tongue projecting longitudinally from one end of the corner guard;

a recess formed in the opposite end of the corner guard to snugly receive a tongue extending from the adjacent end of an adjacent corner guard; and the interior surfaces of the first and second elongated wall sections comprising a lattice of open cells extending along the first and second elongated wall sections from the tongue to the recess.

13. The modular corner guard of claim 12 wherein the lattice of open cells is formed by partition walls located in the interior surfaces of the first and second elongated wall sections, the partition walls are disposed transversely to the length of the first and second elongated wall sections and spaced apart from each other to define an open cell between adjacent partition walls.

14. The modular corner guard of claim 13, wherein the partition walls have edges that are coplanar to each other to cooperatively define the interior surfaces of the first and second elongated wall sections configured for bearing against the object to be protected, the plane defined by the edges of one wall section is disposed at a right angle to the plane defined by the edges of the second wall section.

15. The modular corner guard of claim 14, wherein the tongue flares laterally outward as the tongue extends away from the end of the corner guard.

16. The modular corner guard of claim 15 wherein the recess flares laterally outward as the recess extends into the opposite end of the corner guard to receive the tongue extending from the adjacent end of the adjacent corner guard in locking relationship.

17. The modular corner guard of claim 12, wherein the partition walls define at least one magnet recess for receiving therein a magnet for attaching the corner guard to a ferromagnetic surface to be protected.

18. The modular corner guard of claim 17, wherein the at least one magnet recess is sized and positioned relative to the partition walls so that an exposed surface of the magnet when received in the magnet recess is coplanar with the edges of the partition walls.

19. The modular corner guard of claim 12, wherein the partition walls define at least one surface that is substantially coplanar with the edges of the partition wall to define a surface for receiving an adhesive for attaching the corner guard to a surface to be protected.

20. An elongated, modular corner guard, comprising:

first and second elongated wall sections disposed at an angular relationship to each other, the first and second elongated wall sections each defining an interior surface that are disposed at right angles to each other to be attachable to a corner of an object to be protected, the first and second elongated wall sections having exterior surfaces that are disposed angularly to each other and intersect along their lengths to the sides of a juncture wall that is symmetrical to the right angle defined by the interior surfaces of the first and second elongated wall sections;

the interior surfaces of the first and second elongated wall sections comprising a lattice of open cells;

a tongue projecting longitudinally from one end of the corner guard;

a recess formed in the opposite end of the corner guard to snugly receive a tongue extending from the adjacent end of an adjacent corner guard;

wherein the tongue flares laterally outward as the tongue extends away from the end of the corner guard, wherein the tongue forming a first interior tongue surface that is coplanar with the interior surface the first elongated wall section and the tongue forming a second interior tongue surface that is coplanar with the interior surface of the second elongated wall section.

* * * * *